US005421175A

United States Patent [19]

Niu

[11] Patent Number: 5,421,175

[45] Date of Patent: Jun. 6, 1995

[54] STOCKING WASHING MACHINE

[76] Inventor: Chi-Chou Niu, No. 15, Alley 30, Lane 43, Tze-Chiang Street, North Dist., Taichung City, Taiwan, Prov. of China

[21] Appl. No.: 194,387

[22] Filed: Feb. 10, 1994

[51] Int. Cl.[6] ..... D06F 23/02; D06F 39/02; D06F 39/08

[52] U.S. Cl. ..... 68/17 R; 68/24; 68/140; 68/207; 68/208

[58] Field of Search ..... 68/17 R, 24, 140, 207, 68/208

[56] References Cited

U.S. PATENT DOCUMENTS

| | | | |
|---|---|---|---|
| 2,292,787 | 8/1942 | Johnson | 68/208 X |
| 2,986,915 | 6/1961 | Nav | 68/17 R X |
| 3,129,574 | 4/1964 | Wolverton | 68/208 X |
| 3,568,476 | 3/1971 | Seyler | 68/208 X |
| 3,589,150 | 6/1971 | Poletiek et al. | 68/17 R |

*Primary Examiner*—Philip R. Coe

*Attorney, Agent, or Firm*—Morton J. Rosenberg; David I. Klein

[57] ABSTRACT

A stocking washing machine includes a housing which has an access door and an axle hole at two opposite sides, a water intake port and a detergent dispenser at the top, a water drain port at the bottom; a drum received inside the housing and having a drum shaft extended out of the housing through the axle hole; a motor cover covered on the housing over the axle hole; a control panel mounted on the motor cover and consisted of a timer switch and a power indicator lamp, a motor drive controlled by the timer switch to turn the drum shaft causing the drum to rotate on its own axis, a drain control shutter controlled by a drain control switch to open and close the drain port.

1 Claim, 8 Drawing Sheets

STOCKING WASHING MACHINE

BACKGROUND OF THE INVENTION

The present invention relates to a washing machine specifically designed for washing stockings and socks.

A variety of washing machines have been disclosed for washing clothes, and have appeared on the market. These washing machines are commonly bulk and not economic for washing stockings only. Because stockings and socks may cause contamination, people tend to wash them by hand. However, it is labor-consuming to wash stockings and socks by hand. Therefore, there is a heavy demand for an automatic washing machine which is practical and economical for washing stockings and socks.

SUMMARY OF THE INVENTION

The present invention has been accomplished under the aforesaid circumstances. It is therefore an object of the present invention to provide a stocking washing machine which washes stockings and socks automatically. It is another object of the present invention to provide a stocking washing machine which is inexpensive and suitable for personal use. It is still another object of the present invention to provide a stocking washing machine which is compact and can be mounted on the wall. It is still another object of the present invention to provide a stocking washing machine which provides the functions of washing, rinsing, and spinning.

DETAILED DESCRIPTION OF THE PREFERRED EMBODIMENT

Figure 1:
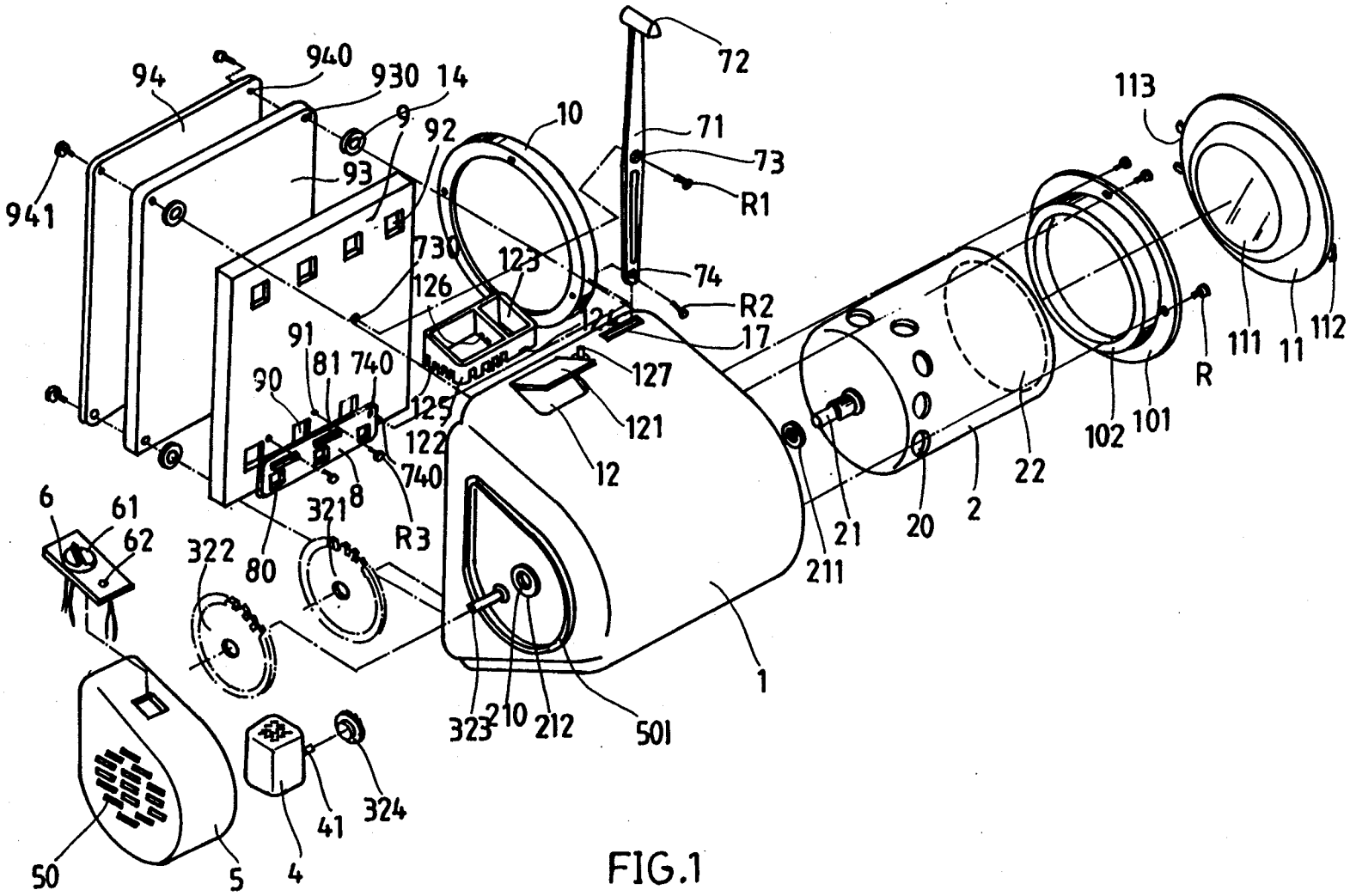
FIG. 1 is an exploded view of a stocking washing machine according to the preferred embodiment of the present invention.
Figure 2:
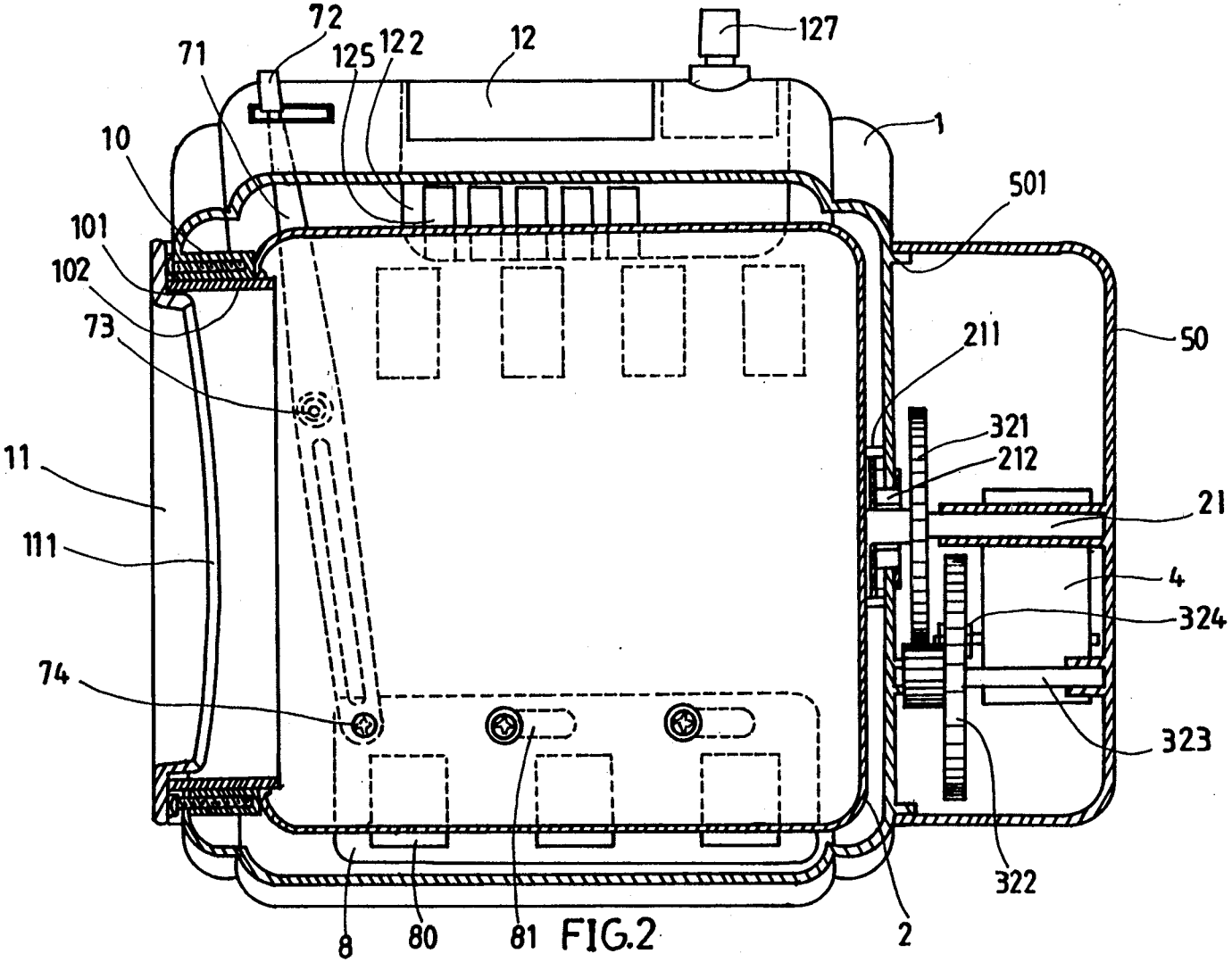
FIG. 2 is a front view in perspective of the stocking washing machine shown in FIG. 1.
Figure 3:
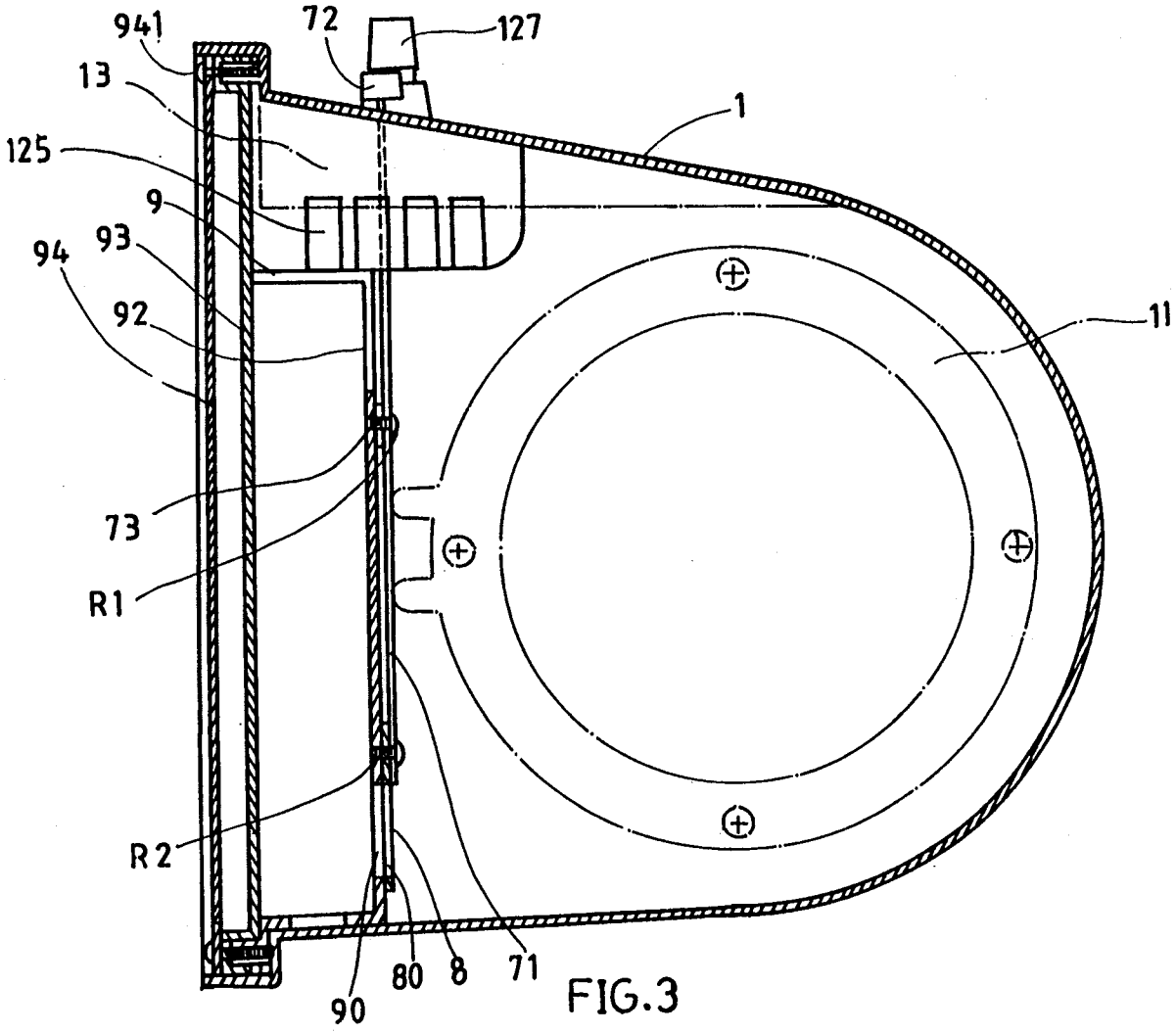
FIG. 3 is a side view in perspective of the stocking washing machine shown in FIG. 1.

Referring to FIGS. 1, 2, and 3, the housing, referenced by 1, comprises an axle hole 210 at one side, an endless flange 501 surrounding the axle hole 210, a dispenser slot 12 at the top, a liftable lid 121 covered on the dispenser slot 12, a water intake port 127 at one side by the dispenser slot 12 for connecting to the water outlet of a water supply pipe, an elongated hole 17 marked with "WASH" and "DRAIN" at two opposite ends, a front opening (not shown) at an opposite side, and a gear shaft 323 disposed on the outside near the axle hole 210. A drum 2 is received inside the housing 1, having a drum shaft 21 at one end and a plurality of drain holes 20 around the periphery and an opening 22 at an opposite end. The drum shaft 21 of the drum 2 is inserted through a washer 21 and extended out of the housing 1 through the axle hole 210. A seal ring 212 is fastened to the axle hole 210 around the drum shaft 21 to seal the gap. A motor cover 5 which has radiation fins 50 is mounted on the endless flange 501 of the housing 1 to hold a motor 4. The motor 4 has a pinion 324 mounted on the output shaft 41 thereof. A driven gear 321 is mounted on the drum shaft 21 of the drum 2. A stepped transmission gear 322 is mounted on the gear shaft 323 and meshed between the pinion 324 and the driven gear 321. An inner locating ring 10 is fastened within the front opening of the housing 1. An outer locating ring 101 is fastened to the inner locating ring 10 by screws R, having an annular flange 101 inserted into the opening 22 of the drum 2. A door 11 is hinged to the outer locating ring 101 by a hinge 113 to seal the opening 22 of the drum 2. The door 11 has a glass cover face 111, through which the inside of the drum 2 is viewed. A lock 112 is made on the door 11 to lock it in the closed position. A control panel 6 is mounted on the motor cover 5, having a timer switch 61 and an indicator lamp 62 respectively and electrically connected to the electric circuit of the motor 4. A detergent dispenser 122 is installed inside the housing 1 below the dispenser slot 12. The detergent dispenser 122 is shaped like a rectangular box divided into two chambers, namely the detergent dispensing chamber 126 and the water intake chamber 123. The detergent dispensing chamber 126 has a plurality of dispensing holes 125 at the bottom. The water intake chamber 123 has a water inlet hole 124 at the bottom aimed at the water intake port 127, and holes (not shown) communicated between the chambers 126; 123. A link 71 is inserted through the elongated hole 17 on the housing 1, having a drain control switch 72 at the top extended out of the housing 1 and a hole 73 in the middle and fastened to a hole 730 on a front drain panel 9 by a screw R1 and a hole 74 at the bottom fastened to a hole 740 on a drain control shutter 8 by a screw R2. The drain control shutter 8 comprises two elongated horizontal holes 81 arranged at the top, and drain holes 80 arranged in a line at the bottom. The front drain panel 9 comprises a plurality of overflow outlets 92 arranged in a line at the top, a plurality of drain holes 90 arranged in a line at the bottom corresponding to the drain holes 80 on the drain control shutter 8, and a plurality of screw holes 91 respectively connected to the elongated horizontal holes 81 by screws R3 permitting the drain control shutter 8 to be moved back and forth horizontally. A back drain panel 93 and a back cover 94 are respectively fastened to the housing 1 at the back to hold the front drain panel 9 in place. The back drain panel 93 and the back cover 94 have screw holes 930; 940 respectively fastened to respective screw holes (not shown) on the back of the housing 1 by screws 941 and water seal rings 14. When installed, the detergent dispenser 122 is supported above the front drain panel 9 and retained within mounting ribs 13 on the housing 1.

Figure 4:
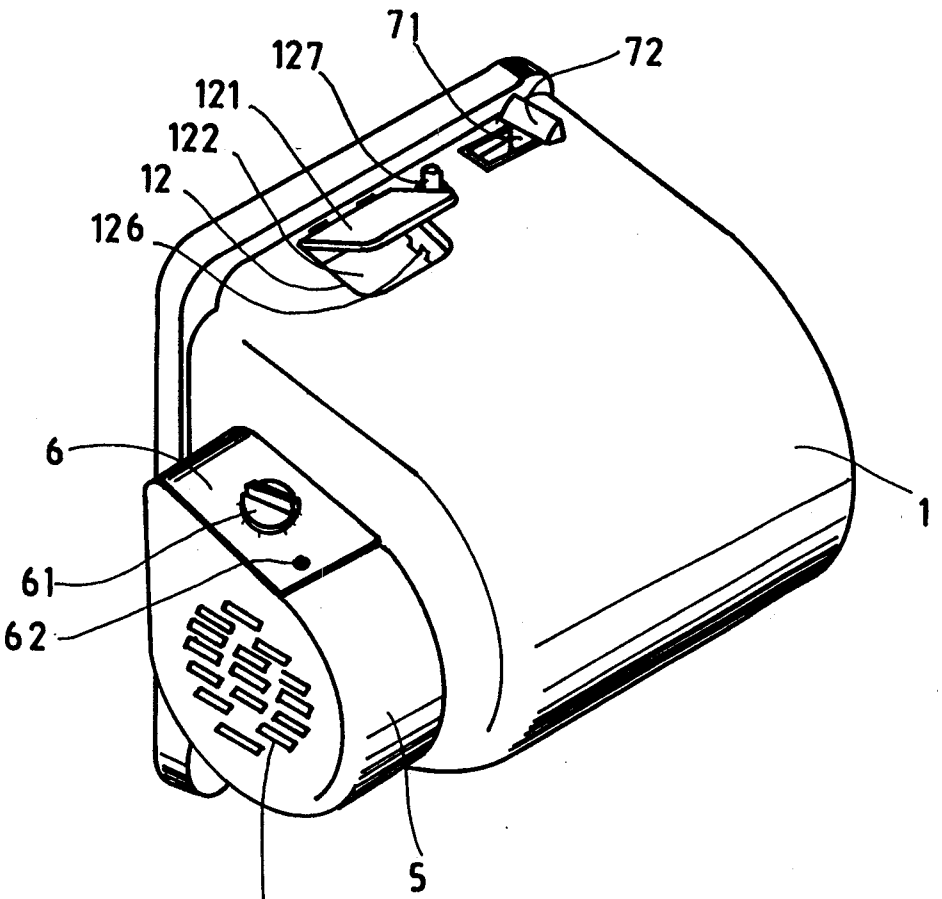
FIG. 4 is an elevational view of the stocking washing machine shown in FIG. 1.

Referring to FIG. 4, the stocking washing machine can be fastened to the wall and conveniently operated by turning the timer switch 61 on the control panel 6 above the motor cover 5. When the stocking washing machine is operated, the indicator lamp 62 gives light. When the lid 121 is lifted, a detergent can be put into the detergent dispenser 122 through the dispenser slot 12. The drain control switch 72 may be moved in either direction so as to control the act of draining. The door 11 can be opened so that stockings and socks can be put into the drum 2 for washing. When the door 11 is closed, the user can monitor the washing of the stocking washing machine through the glass face cover 111.

Figure 5:
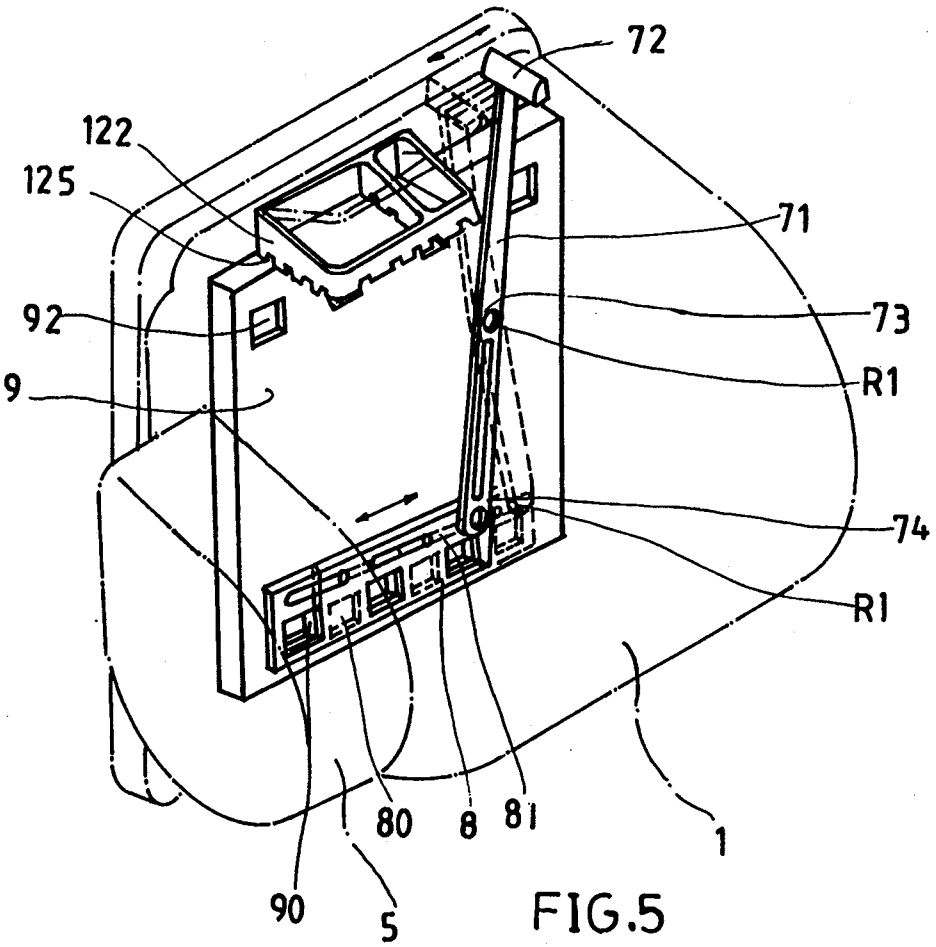
FIG. 5 shows the stocking washing machine operated under the mode of DRAIN.

Referring to FIG. 5, when the drain control switch 72 is moved toward the right, the link 71 is turned about the screw R1 causing the drain control shutter 8 moved toward the left (OFF position), and therefore the drain holes 80 on the drain control shutter 8 are moved away from the drain holes 90 on the front drain panel 9 and water is stopped from passing through the drain holes 80. On the contrary, when the drain control switch 72 is moved toward the left (ON position), the link 71 is turned about the screw R1 causing the drain control shutter 8 moved toward the right, and therefore the drain holes 80 on the drain control shutter 8 are respectively aligned with the drain holes 90 on the front drain panel 9 permitting water to flow out of the housing 1 through a drain port 15 at the bottom of the housing 1.

Figure 6:
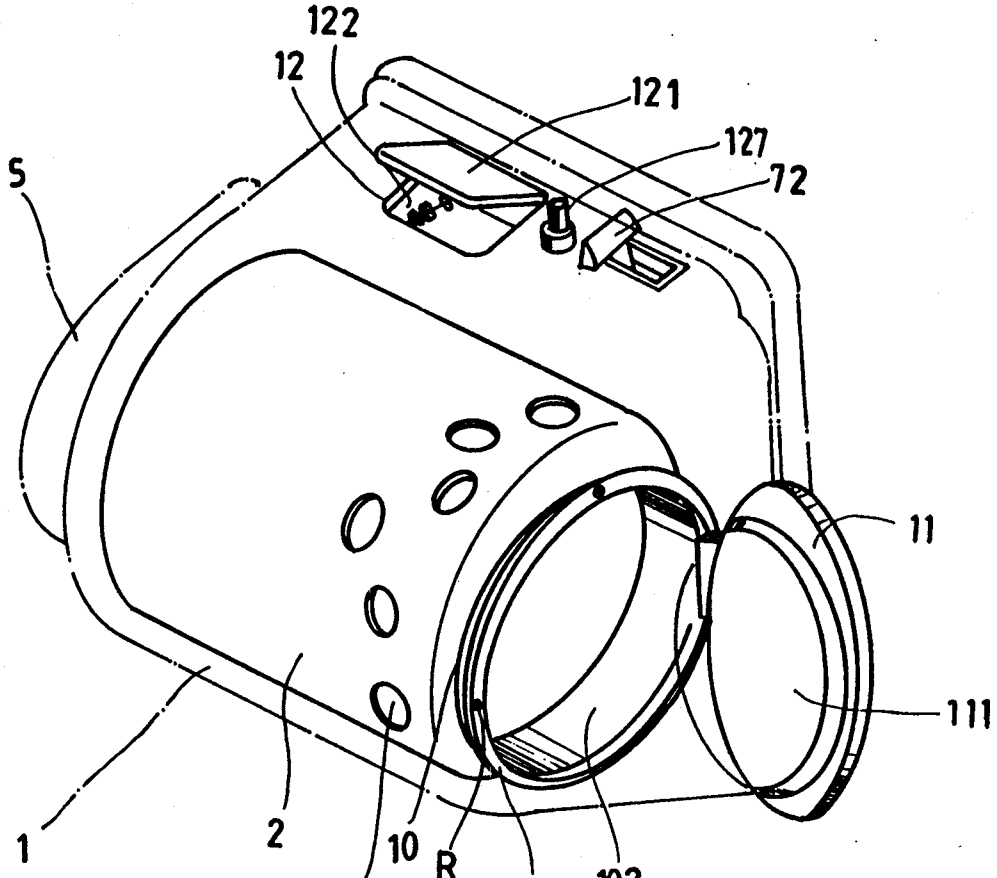
FIG. 6 shows the stocking washing machine operated under the mode of WASH.

Referring to FIG. 6, when the stockings or socks G to be washed have been put into the drum 2, the door 11 is closed, then the drain control switch 72 is moved to OFF position, then a proper amount of the detergent is put into the detergent dispenser 122 and water is guided into the drum 2 through the water intake port 127, and then the timer switch 61 is turned to the desired setting time causing the motor 4 to turn the drum 2. When water is guided into the water intake port 127, it flows through the water intake chamber 123 into the drum 2, and at the same time part of water flows from the water intake chamber 123 into the detergent dispensing chamber 126 to mix with the detergent and then to carry the detergent out of the detergent dispenser 122 into the drum 2 through the dispensing holes 125. When the drum 2 is being turned round and round, the stockings G are rubbed in water and cleaned by the detergent.

Figure 7:
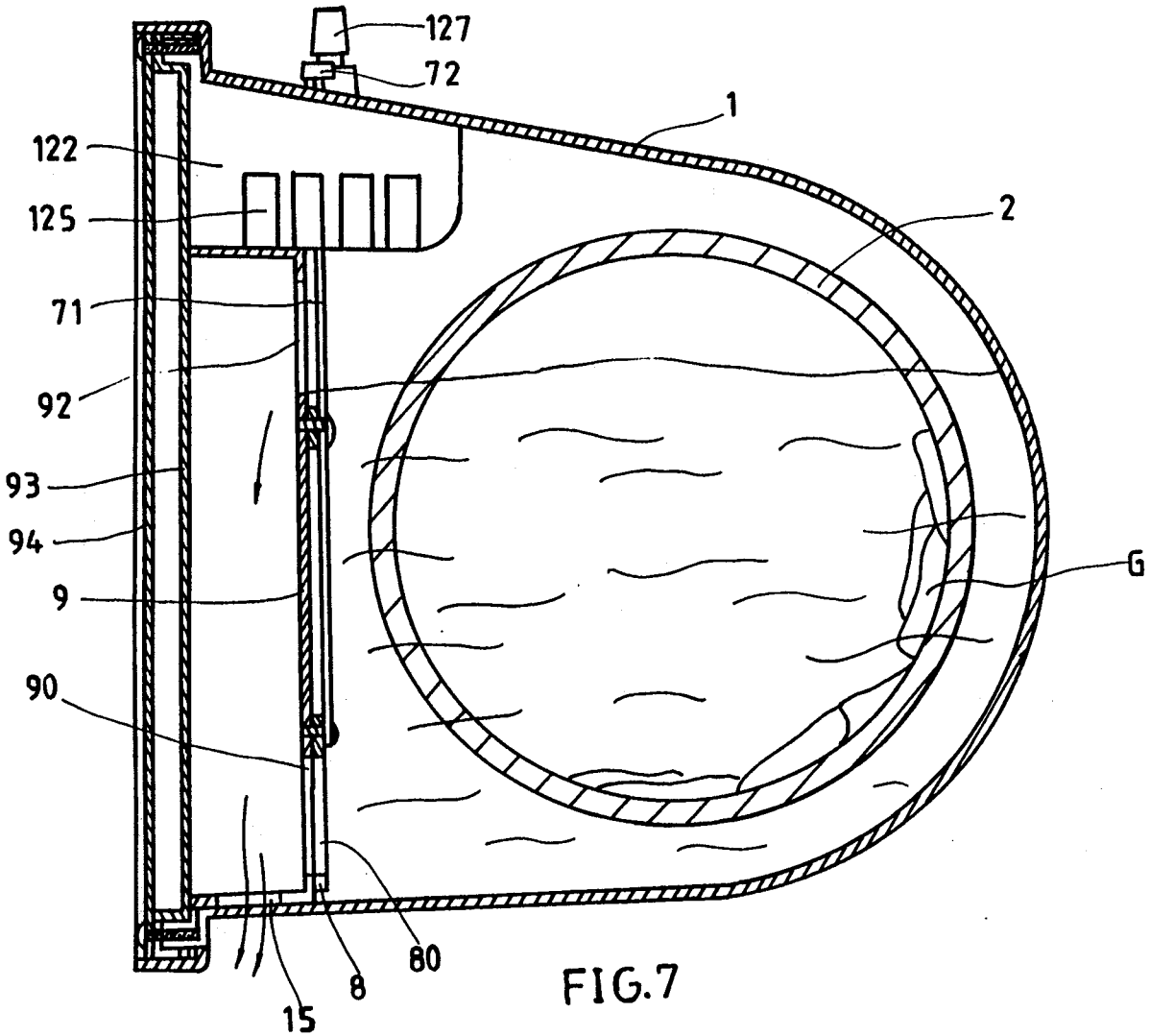
FIG. 7 shows the stocking washing machine operated under the mode of CLEAN.

Referring to FIG. 7, after washing, cleaning water is continuously guided into the drum 2 while the supply of the detergent is stopped. When water level is increasing, the overflow of water flows through the overflow outlets 92 out of the housing 1 via the drain port 15.

Figure 8:
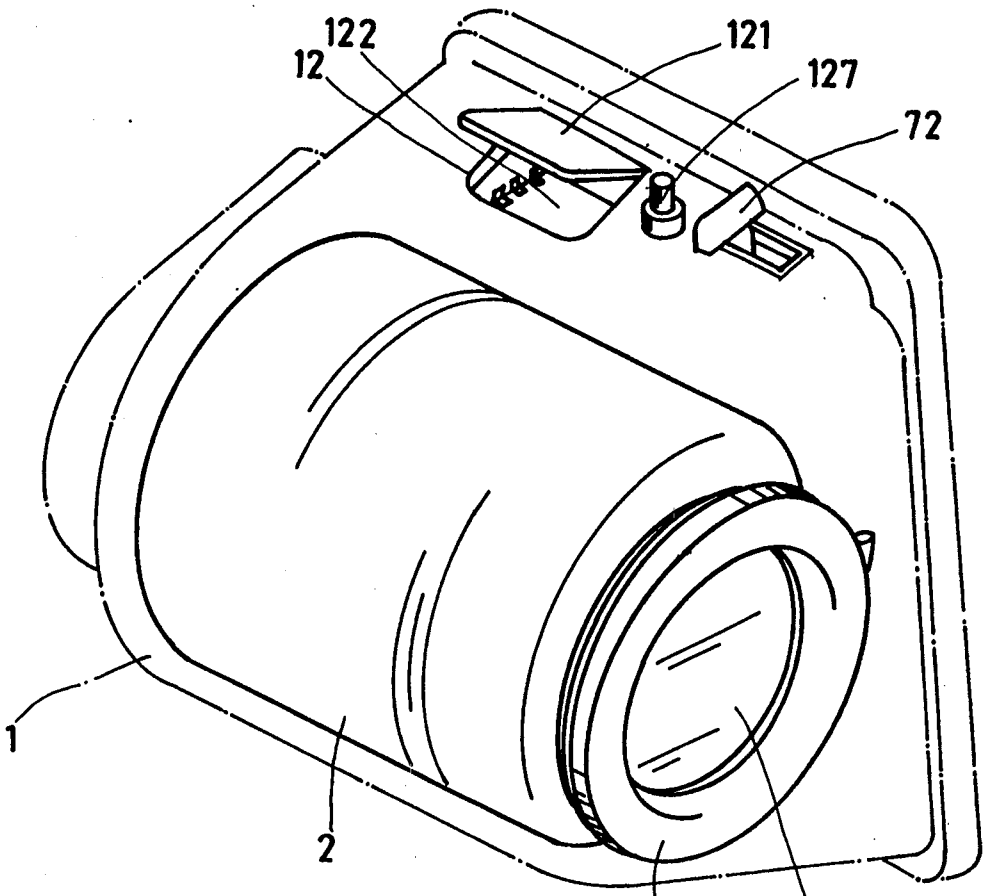
FIG. 8 shows the stocking washing machine operated under the mode of SPINNING.

Referring to FIG. 8, after cleaning, water is stopped from being sent into the drum 2, then the drain control switch 72 is moved to ON position, and then the timer switch 61 is turned to the desired setting time causing the drum 2 to spin, and therefore a centrifugal effect is produced to remove water from the stockings G permitting water to be expelled out of the housing 1 through the drain holes 90 and the drain port 15.

What is claimed is:

1. A stocking washing machine, comprising:

a housing having a cavity defined by a pair of opposing lateral sides, and respective top and bottom walls, said cavity being open to a rear side of said housing, a first of said pair of lateral sides having an axle hole formed therethrough, a second of said pair of lateral sides having an access opening formed therethrough, said bottom wall having a drain port formed therein, said top wall having a water intake port and a dispenser slot formed therein, said housing further including a liftable lid covering said dispenser slot, an access door hingedly coupled to said second lateral side for providing a closure for said access opening, and a back cover disposed on said rear side of said housing for forming a closure for said cavity;

a drum disposed within said housing cavity, said drum having a longitudinally extended cylindrical wall with a plurality of drain holes formed therethrough, said drum having an open end facing said access opening of said housing and a drum shaft extending longitudinally from an opposing end of said drum, said drum shaft extending through said housing axle hole;

a motor drive coupled to said drum for rotation of said drum about said drum shaft, said motor drive including a motor mounted external to said housing and having an output shaft, a pinion gear coupled to said motor output shaft, and a transmission gear set coupled to said drum shaft and said pinion gear;

a motor cover mounted to said housing and covering said motor;

a control panel coupled to said motor cover, said control panel including a timer switch and a power indicator lamp electrically coupled to said motor;

a detergent dispenser disposed within said housing cavity between said dispenser slot and said drum, said detergent dispenser including (1) a detergent dispensing chamber disposed in aligned relationship with said dispenser slot, and (2) a water intake chamber disposed in aligned relationship with said intake port and in fluid communication with said detergent dispensing chamber;

a drain panel assembly disposed between said housing and said back cover, said drain panel assembly having a plurality of drain holes in fluid communication with said drain port of said housing;

a drain control shutter disposed between said drain panel and said drain port for blocking and unblocking said drain panel drain holes responsive to said drain control shutter being slidably displaced between a first position and a second position; and, a drain control switch means having a handle end portion and a distal end portion coupled to said drain control shutter, said drain control switch means being pivotally coupled to said housing for displacing said drain control shutter between said first and second positions responsive to a respective displacement of said handle end portion.

* * * * *